United States Patent [19]

Greco

[11] 4,443,636

[45] Apr. 17, 1984

[54] REFINING LURGI TAR ACIDS

[75] Inventor: Nicholas P. Greco, Edgewood, Pa.

[73] Assignee: Koppers Company, Inc., Pittsburgh, Pa.

[21] Appl. No.: 398,074

[22] Filed: Jul. 14, 1982

[51] Int. Cl.[3] ..... C07C 37/74

[52] U.S. Cl. ..... 568/761; 568/749; 568/759

[58] Field of Search ..... 568/761, 759, 749, 761

[56] References Cited

U.S. PATENT DOCUMENTS 1,029,438 10/1933 McKee ..... 568/761

1,819,687 8/1931 Miller ..... 568/761

2,006,589 7/1935 Engel ..... 568/762

*Primary Examiner*—Werren B. Lone

*Attorney, Agent, or Firm*—Daniel J. Long; Herbert J. Zeh, Jr.

[57] ABSTRACT

There is disclosed a process for removing tar bases and neutral oils from the Lurgi tar acids by treating the tar acids with aqueous sodium bisulfate to change the tar bases to salts and to hydrolyze the neutral oils to hydrolysis products and distilling the tar acids to obtain refined tar acid as the distillate while the tar base salts and neutral oil hydrolysis products remain as residue.

2 Claims, No Drawings

REFINING LURGI TAR ACIDS

CROSS-REFERENCE TO RELATED APPLICATIONS

The invention described in application Ser. No. 398,068 filed on even date with Robert L. Lovell listed as inventor is related in that both applications are assigned to the same assignee and both involve the purification of Lurgi tar acids by separating out the tar base and neutral oil components.

BACKGROUND OF THE INVENTION

1. Field of the Invention

This invention relates generally to tar acid and more particularly to the reduction of the inherent impurity constituents in tar acids.

2. Prior Practice

Crude tars contain tar acids, tar bases, and neutral oils. These are commercially valuable substances. The crude tar is subjective to distillation to remove these compounds and change the characteristics of the tar. Unfortunately, the boiling point of the various ingredients of the crude tar tend to overlap and therefore the specific ingredients are not readily separated by distillation of the tar. Accordingly, the tar is first subjective to distillation that gives cuts encompassing a wide range of temperatures.

The first distillate fraction is that which distills from tar at temperatures below 230°–240° C. is generally referred to as "tar acids" and is mainly comprised of hydroxy benzenes such as phenols and homologues. This distillate may then be separated either by chemical means or by physical means such as fractional distillation into comparatively pure components, usually as phenol, ortho cresol, meta and para cresol and the six isomers of xylenols. Usually the distillate fraction also include some "tar bases" which are mainly cyclic, nitrogen containing compounds such as pyridine, picoline, lutidine, collidine, aniline, toluidine, xylidine, quinoline, isoquinoline and quinaldine. The distillate fraction may also include some "neutral oil" which is comprised hydrocarbon derivatives of benzene and naphthalene. As may be expected, the composition of a cut depends upon the tar from which the cut is obtained.

The main source of tar acids has heretofore been the tar that is obtained as the by-product of the coking of coal. The tar acids fraction obtained by the distillation of this tar is about 10–20% of the crude coal tar.

Recently a source of tar acids has become available from the Lurgi gasification process. The Lurgi process uses oxygen and steam to gasify brown coal, lignite and non coking sub-bituminous coals in a fixed bed at pressures of 0 to 20 atmospheres and produce a fuel gas. The crude gas leaving the gasifies contains carbonization products such as tar, oil, naphtha, phenols, cyanides, and coal and ash dusts. The gas is cleaned, i.e., these products are removed from the gas before the gas is used as a fuel. The tar that is thus obtained is subjected to distillation in the same manner as in the tar obtained from the production of coke to obtain various distillation cuts.

Tar acids are valuable commercially in the production of numerous items such as resins, plasticizers, and disinfectants. The boiling points of the tar acids, tar bases and neutral oil are such that they cannot be effectively separated by distillation alone. The contamination of the tar acids by the tar bases and neutral oils impair the utility of the tar acids.

The tar acid distillate cut from the by-product tar from the Lurgi process and popularly termed "Lurgi tar acids" has a composition typically comprising 93% tar acids, 5% tar base and 2% neutral oil.

Heretofore, tar acids containing neutral oils and tar bases have usually been extracted with certain selected solvents or combinations of solvents which extracts contained neutral oils leaving a mixture of tar bases and tar acids. The tar bases may be extracted from this mixture with an aqueous solution of a mineral acid, usually aqueous sulfuric acid. Finally, the remaining tar acids are water washed before distilling. The mineral acid extraction must be such that the tar acids are free or nearly free of nitrogenous compounds in order to be salable.

SUMMARY OF THE INVENTION

I have discovered a simplified method of accomplishing the purification of these Lurgi tar acids which is more practical than that now being used. My process eliminates solvents and water washing and yields a salable grade of tar bases.

My process involves treating the tar acids with sodium bisulfate to convert the tar bases to salts and hydrolyze the neutral oils. I have found that sodium bisulfate does not sulfonate the tar acid even at higher temperature. Higher boiling tar acids require higher still temperatures to recover them by distillation. My invention permits the higher boiling tar acids to be purified and recovered by distillation because they will not be sulfonated in the distillation pot by the sodium bisulfate. The refined tar acids are recovered as distillate while the tar acids remain as salts in the residue and the neutral oils remain in the residue as hydrolyzed products.

The process may be more clearly understood from a description of the manner in which I have carried out my invention, it being understood that the parts as used below are parts by weight.

DETAILED DESCRIPTION OF THE INVENTION

A tar acid fraction (Lurgi tar acid) that had been derived from the tarry product that was produced as a by-product of the Lurgi coal gasification process was analyzed and found to contain by weight 93.2% tar acids, 5.3% tar bases and 1.5% neutral oils. Lurgi tar acid fraction first distilled to a vapor temperature of 230° C. at ordinary atmospheric conditions. This distillation or "depitching" removed some of the higher boiling undesirable products from the tar acid fraction. The desirable component was the distillate and the undesirable component was the residue.

The distillate (100 parts) were agitated with a 50% aqueous solution of sodium acid sulfate (50 parts) and refluxed at 140° C. (pot temperature). A small amount of the water distilled from the mixture before the pot temperature rose to 140° C. Some of the tar acids which steam distilled during this heating period were recovered for recycle. After about 1 hour of refluxing, water was distilled from the reaction mixture and the dried reaction mixture filtered. The filtrate was distilled at 30 mm through a 24" Vigreaux column and gave an distillate 89 parts of water white tar acids free of neutral oil and for practical purposes free of tar bases. The distillate which was purified tar acids that contained only 0.015% by weight nitrogen and remained water white for months.

What is claimed:

1. A process for refining the tar acid fraction that is derived from the Lurgi gasification of coal comprising:

(a) treating the tar acid with an aqueous solution of sodium bisulfate; and (b) distilling off the tar acids as distillate while the tar bases remain as salts in the residue and the neutral oils hydrolyze to products that also remain the residue.

2. A process for refining the tar acid fraction that is derived from the tarry by-product of the Lurgi gasification of coal comprising:

(a) distilling the tar acid fraction at atmospheric pressure to 230° C. and obtaining the distillate;

(b) treating the distillate with an aqueous solution of sodium acid sulfate;

(c) filtering the solids from the mixture; and (d) distilling the tar acids from the filtrate.

* * * * *